US009476295B2

(12) United States Patent
Bergman

(10) Patent No.: US 9,476,295 B2
(45) Date of Patent: Oct. 25, 2016

(54) PLUNGER FALL TIME IDENTIFICATION METHOD AND USAGE

(71) Applicant: CONOCOPHILLIPS COMPANY, Houston, TX (US)

(72) Inventor: Patrick W. Bergman, Fulshear, TX (US)

(73) Assignee: ConocoPhillips Company, Houston, TX (US)

( * ) Notice: Subject to any disclaimer, the term of this patent is extended or adjusted under 35 U.S.C. 154(b) by 287 days.

(21) Appl. No.: 14/027,596

(22) Filed: Sep. 16, 2013

(65) Prior Publication Data

US 2014/0102698 A1 Apr. 17, 2014

Related U.S. Application Data

(60) Provisional application No. 61/713,755, filed on Oct. 15, 2012.

(51) Int. Cl.
*E21B 47/09* (2012.01)
*E21B 43/12* (2006.01)

(52) U.S. Cl.
CPC ..... *E21B 47/09* (2013.01); *E21B 43/121* (2013.01)

(58) Field of Classification Search
CPC ... E21B 47/0007; E21B 47/09; E21B 43/121
See application file for complete search history.

(56) References Cited

U.S. PATENT DOCUMENTS

| | | | | |
|---|---|---|---|---|
| 7,445,048 | B2 | 11/2008 | Sheffield | |
| 7,490,675 | B2 | 2/2009 | Hearn | |
| 7,819,189 | B1 | 10/2010 | Cosby | |
| 2006/0155473 | A1* | 7/2006 | Soliman et al. | 702/12 |
| 2008/0164024 | A1 | 7/2008 | Giacomino | |
| 2010/0106422 | A1 | 4/2010 | Byme et al. | |
| 2011/0060472 | A1 | 3/2011 | Ocondi et al. | |

OTHER PUBLICATIONS

Becker, Dieter, et al. "Plunger Lift Optimization by Monitoring and Analyzing Wellbore Acoustic Signals and Tubing and Casing Pressures." SPE Eastern Regional Meeting. 2006.

* cited by examiner

*Primary Examiner* — David Andrews
*Assistant Examiner* — Kristyn Hall
(74) *Attorney, Agent, or Firm* — ConocoPhillips Company

(57) ABSTRACT

A method for determining when a plunger reaches the bottom of an oil or gas well equipped with a plunger lift system. More particularly, the method identifies a surface pressure associated with the plunger reaching the bottom.

1 Claim, 8 Drawing Sheets

PLUNGER FALL TIME IDENTIFICATION METHOD AND USAGE

CROSS-REFERENCE TO RELATED APPLICATIONS

This application is a non-provisional application which claims benefit under 35 USC §119(e) to U.S. Provisional Application Ser. No. 61/713,755 filed Oct. 15, 2012, entitled "PLUNGER FALL TIME IDENTIFICATION METHOD AND USAGE," which is incorporated herein in its entirety.

FIELD OF THE INVENTION

This invention relates to a method for determining when a plunger reaches the bottom of an oil or gas well equipped with a plunger lift system. More particularly, the method identifies a surface pressure associated with the plunger reaching the bottom.

BACKGROUND OF THE INVENTION

Oil and natural gas are often found together in the same reservoir. The composition of the raw natural gas extracted from producing wells depends on the type, depth, and location of the underground deposit and the geology of the area. During production, oil, gas, and water flow to the surface, passing as an emulsion or a mixture.

During a well's flowing life, as rates and gas velocities decrease, liquids will start to collect at a well bottom, causing a gradual increase in back pressure. Fluid buildup may cause the lifting efficiency of a well to decrease and in some cases, may even cause a well to cease to flow.

Operators may use any number of artificial lift techniques to raise fluid to the surface after a well slows or ceases to flow. One known method comprises plunger lift. The function of the plunger is to prevent fluid buildup from accumulating to the point that they would cause a decrease in rate or cause the well to no longer flow.

The operation of a plunger lift system relies on the natural buildup of pressure in a well during the time that the well is shut in at the surface by a wellhead controller (or in an "off" mode). When a well is shut in, pressure is allowed to build up. In a shut in mode, no production occurs at the surface. When pressure has sufficiently built up to enable the accumulated liquids in the tubing to be lifted along with the plunger, the well is opened to production. A plunger lift system operates to "lift" oil or water and natural gas from a well bottom during natural gas production when the well is in an "on" mode, thus unloading fluid buildup and increasing the productivity of oil and natural gas wells. Functionally, the plunger provides a mechanical interface between the produced liquids and the gas. This mechanical interface minimizes liquid fallback which thereby boosts a well's lifting efficiency.

In the industry, the optimization of plunger lift has primarily focused on changing the on/off cycle time based on factors such as time, differential pressure, plunger arrival speeds, etc. In fact, most plunger lift controllers commonly pre-set a minimum off time or fall time on the premise that this minimum time will allow the plunger to fall safely to the bottom of the well before the on time cycle is enabled. Since minimizing the shut-in time is an important part of the optimization process, it is important to know when the plunger has reached the bottom of the well.

It is well-known in the industry that the science of determining fall time can be imprecise without the use of very specialized equipment. In general, operators often determine that the plunger is on bottom based on an arbitrary interval of time, a guess, or an estimate based on the type of plunger, its estimated fall velocity and the depth of the well. For example, an operator can assume it takes a plunger 45 minutes to travel to well bottom. This travel time is typically referred to as "fall time," which can be the actual or estimated interval of time when a motor valve is shut to close the flow line and when the plunger hits bottom. Many factors, however, can affect the actual fall time of a plunger. Different types and brands of plungers fall at different rates. For example, a 2⅜" pad-type plunger can have a fall time of about 48 minutes depending on the depth of the well. In the same well, a bar-stock plunger might fall in about 22 minutes; a by-pass plunger could reach bottom in as little as seven minutes. In addition, new plungers have been observed to fall at different rates than worn plungers.

Fall time can also be a function of a well's depth and the amount and composition of liquid in the well. Well maturity can also alter plunger fall times. As a well matures, it can produce more or less fluid through which a plunger falls. In addition, the presence of salt, sand, or solids can have an influence on how quickly the plunger reaches bottom. Well bore features can also affect fall time. Such features can include but are not limited to the condition of the tubing, whether the tubing is rough or smooth, the type of rod-cuts, the existence of tight spots, scale, and/or paraffin build up and the well's trajectory (vertical vs. deviated). Other conditions affecting plunger fall time would be known to those skilled in the art.

Therefore, a need exists for a method for determining when a plunger reaches the bottom of an oil or gas well equipped with a plunger lift system.

SUMMARY OF THE INVENTION

In an embodiment, a method for identifying when a plunger reaches the bottom of a well with a plunger lift system, includes: (a) shutting in the well, wherein by shutting in the well the plunger is allowed to fall to the bottom the well and to build up energy; (b) obtaining data as the plunger falls to the bottom of the well, wherein the data includes pressure measurement and a corresponding time measurement; (c) establishing a relationship between a change in pressure and a change in time, wherein the relationship provides $$m = \frac{P_2 - P_1}{\left(\sqrt{T_2} - \sqrt{T_1}\right)}$$

in which m is the rate of change, $P_1$ is the pressure at a corresponding time $T_1$ and $P_2$ is the well pressure at a corresponding time $T_2$; (d) calculating rate of change for each data point obtained while the well is shut in; (e) plotting the rate of change versus time; and (f) identifying the maximum rate of change during the energy build up while filtering out anomalies not associated with the plunger reaching bottom.

BRIEF DESCRIPTION OF THE DRAWINGS

The invention, together with further advantages thereof, may best be understood by reference to the following description taken in conjunction with the accompanying drawings in which.

DETAILED DESCRIPTION OF THE INVENTION

Reference will now be made in detail to embodiments of the present invention, one or more examples of which are illustrated in the accompanying drawings. Each example is provided by way of explanation of the invention, not as a limitation of the invention. It will be apparent to those skilled in the art that various modifications and variations can be made in the present invention without departing from the scope or spirit of the invention. For instance, features illustrated or described as part of one embodiment can be used in another embodiment to yield a still further embodiment. Thus, it is intended that the present invention cover such modifications and variations that come within the scope of the appended claims and their equivalents.

In a well that uses a plunger lift system for artificial lift, a piston is cycled between the surface and the bottom of the well to assist in bringing liquids to the surface. The well is shut in, i.e., production halted, in order for the plunger, i.e., piston, to fall to the bottom of the well and to build energy to lift the piston and the fluid. The well is then turned back on and the plunger and fluid slug rise to the surface. Once the well is shut in, the pressure in the wellbore begins to increase, i.e., build up. The pressure seen at the surface is equivalent to the bottom hole pressure in the well less the weight of the hydrostatic column from the bottom of the well to the surface (hydrostatic weight of the gas, liquid, etc.). As the plunger is falling to the bottom of the well, its' weight is part of the hydrostatic column in which it is falling. Once it reaches the bottom of the well, its' weight is transferred to the tubular upon which it is resting. This transfer causes an increase in surface pressure, resulting in a positive/upward shift in the surface pressure build up trend. The pressure increase occurs at the surface of the tubing string in which the plunger is falling.

As discussed above, the well needs to be shut-in long enough for the plunger to reach the bottom of the well. In industry, operators often estimate the time required for the plunger to fall to the well bottom. With the application of the disclosed method, the operator or well controller may determine the actual fall time of each plunger cycle.

Figure 1:
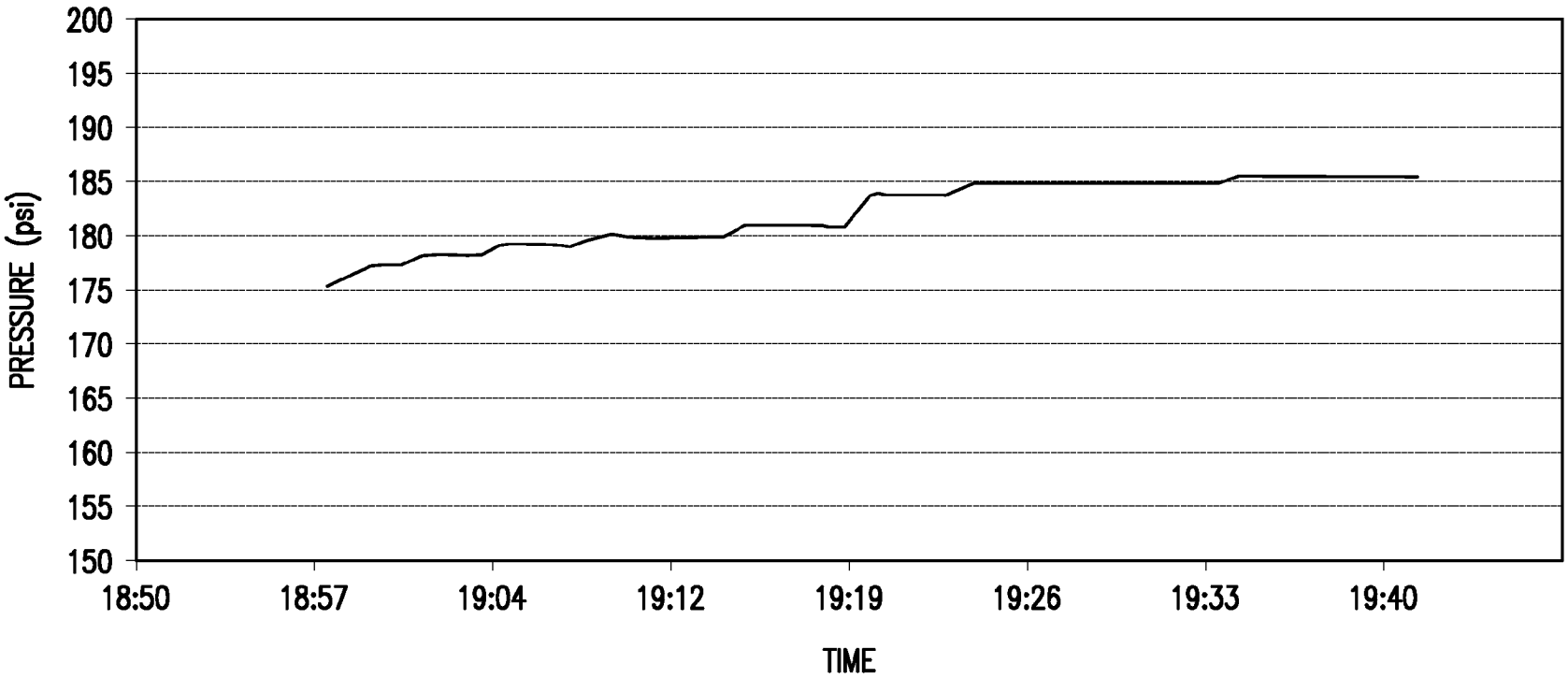
FIG. 1 is a graphical depiction of surface pressure versus time during the shut-in portion of a cycle in a well utilizing a plunger lift system.
Figure 2:
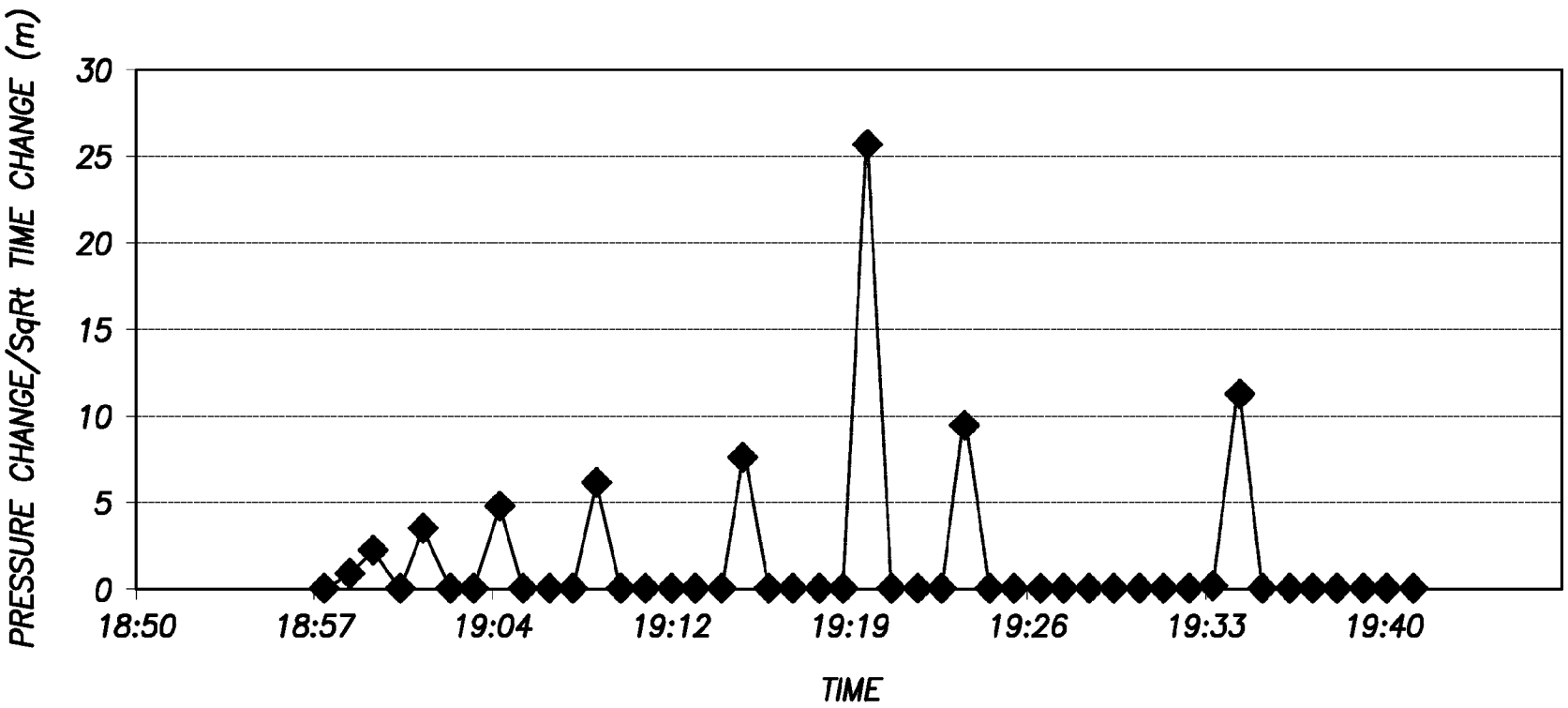
FIG. 2 is a graphical depiction of the change in pressure divided by the square root of time versus time for the shut-in portion of a cycle in a well utilizing a plunger lift system.

FIGS. 1-2 depict a portion of a test conducted on a well employing plunger lift for a cycle, i.e., interval of time during which the well was shut-in, which includes that portion when the plunger is released from the top of the well until it reaches the bottom of the well. FIGS. 1-2 depict the portion of the test run occurring at about 18:50 hours to about 19:50 hours. The well data was gathered by means of a plunger lift system having a computer housed to collect well data. In FIG. 1, surface pressure data is collected in the afore mentioned computer about every minute using a pressure measuring device (pressure transducer).

In FIG. 1, when the well is shut in, the plunger falls toward the bottom of the well, traveling toward a lower bumper spring or stop located in the bottom section of the well. During the time when the well is shut-in, well pressure can be seen to increase. FIG. 1 depicts the pressure build up as a constant relationship between pressure and the corresponding time. The stair step character of the chart for this test well is a function of the resolution of the pressure measuring device. The start of the pressure build up is time zero, the first minute being time 1, and so on.

To determine the when the plunger reaches bottom (plunger bottoming) in any single cycle, a relationship is established between the change in surface pressure within the well and the associated change in time, providing:

$$m = \frac{P_2 - P_1}{(\sqrt{T_2} - \sqrt{T_1})}$$

where $P_1$ is the pressure at a corresponding time $T_1$, $P_2$ is the well pressure at a corresponding time $T_2$ and m is rate of change in pressure per square root of time calculated for each point throughout the pressure build up.

FIG. 2 is a graphical depiction of the rate of change (m) versus the corresponding time. When the plunger reaches the bottom of the well, a positive shift in the surface pressure build up should occur resulting in a larger than normal positive rate of change to occur at that point during the buildup as depicted in FIG. 2. The rate of change (m) when the plunger reaches bottom is larger than the rate of change (m) that is observed while the plunger is falling or after it is resting at the bottom of the well, i.e. a normal straight line relationship (FIG. 2 dashed line). The plunger reaching the bottom of the well should be at a point in time where the value of the rate of change (m) is at a maximum, unless there are other extenuating circumstances.

FIG. 2 also depicts data points showing zero values for the rate of change (m), which can be caused by the resolution of pressure transducer. If the rate of pressure build up is so low, the pressure transducer may not detect a pressure increase for those points.

Using the surface pressure increase characteristic allows for the plunger fall time to be observed anytime surface pressure is tracked at a frequency and resolution sufficient to see the characteristic pressure increase/shift. There are many uses for the actual plunger fall time, for example, determining the minimum shut in time or monitoring plunger wear, if tracked over an extended period (number of cycles). As a plunger's sealing components wear out, the plunger fall time should decrease (the more the plunger wears, the poorer the seal and the faster the fall velocity). The actual plunger fall time can also be used to determine if the plunger is becoming lodged in the tubing and not reaching the bottom of the well, i.e., seeing the pressure anomaly much sooner than expected. If tracked over many cycles, increases in fall time can indicate that foreign materials may be being deposited in the tubing string, slowing down the plunger fall velocity.

Figure 3:
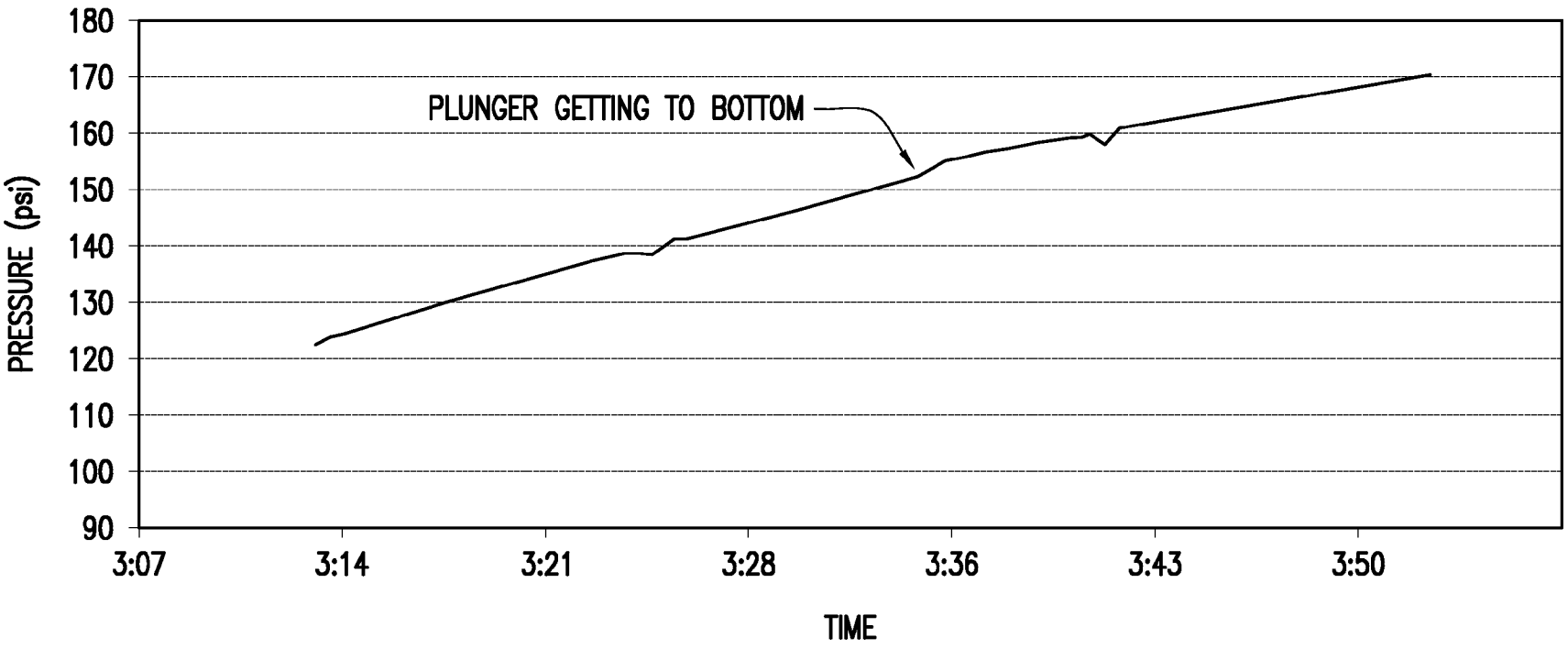
FIG. 3 is a graphical depiction of surface pressure versus time during the shut-in portion of a cycle in a well utilizing a plunger lift system.
Figure 4:
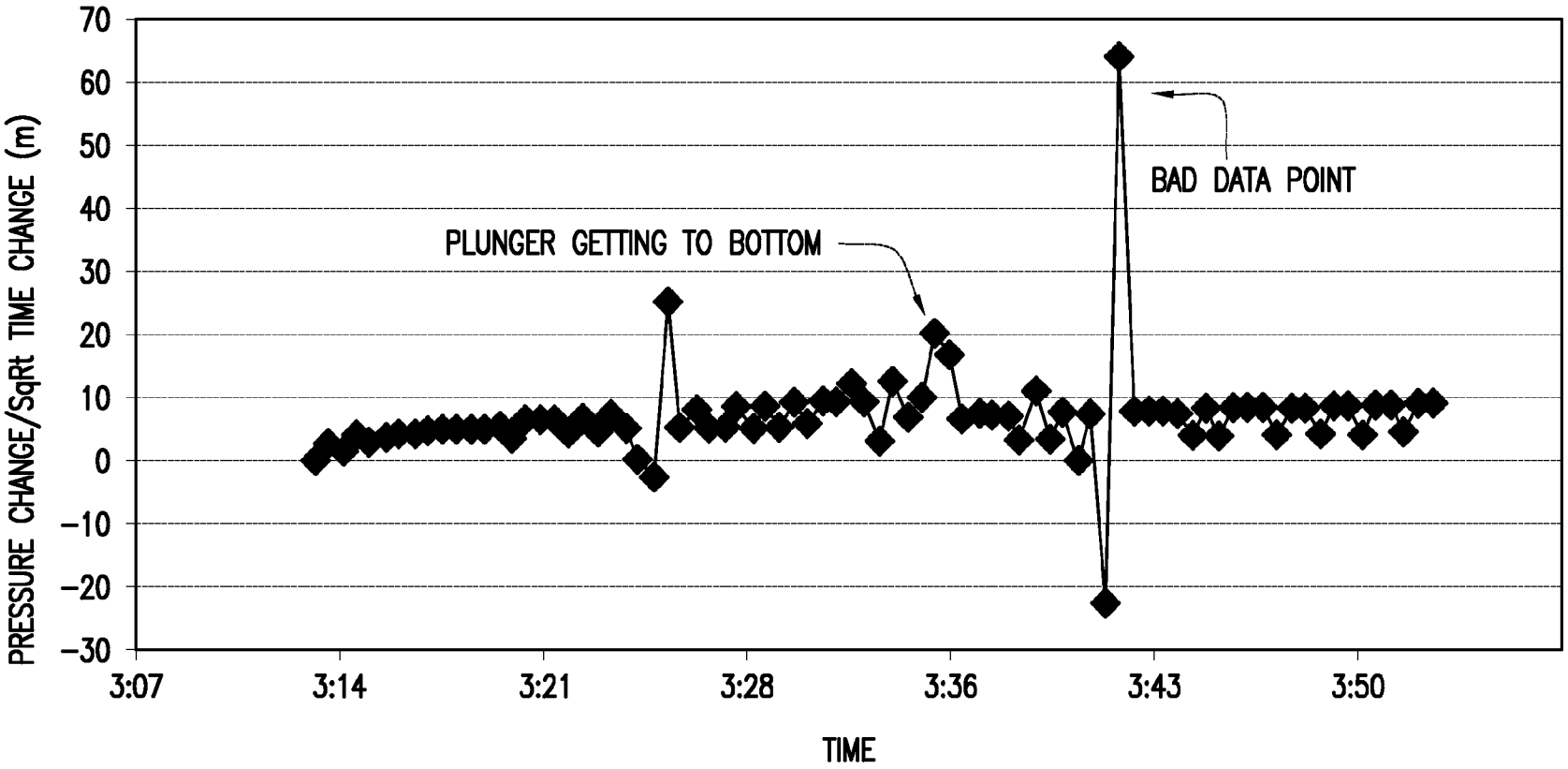
FIG. 4 is a graphical depiction of the change in pressure divided by the square root of time versus time for the shut-in portion of a cycle in a well utilizing a plunger lift system.

When tracking surface pressure there can be other reasons for increases/shifts in the pressure build-up trend, such as bad data, fluid exiting the tubing, etc. FIGS. 3-8 depict portions of tests conducted to filter out those anomalies so as to determine which increase/shift is caused by the plunger getting to the bottom of the well. FIGS. 3 and 4 shows the presence of anomalies in the raw data (FIG. 3) and the effect of the anomalies when the rate of change (m) calculations are made (FIG. 4). To filter out anomalies, the data from several consecutive cycles are compared to determine the point in time where the anomalies occur most consistently. Pressure increases/shifts associated with plunger bottoming should occur more consistently than those anomalies caused by other things (bad data, leaking valves, etc.).

Figure 5:
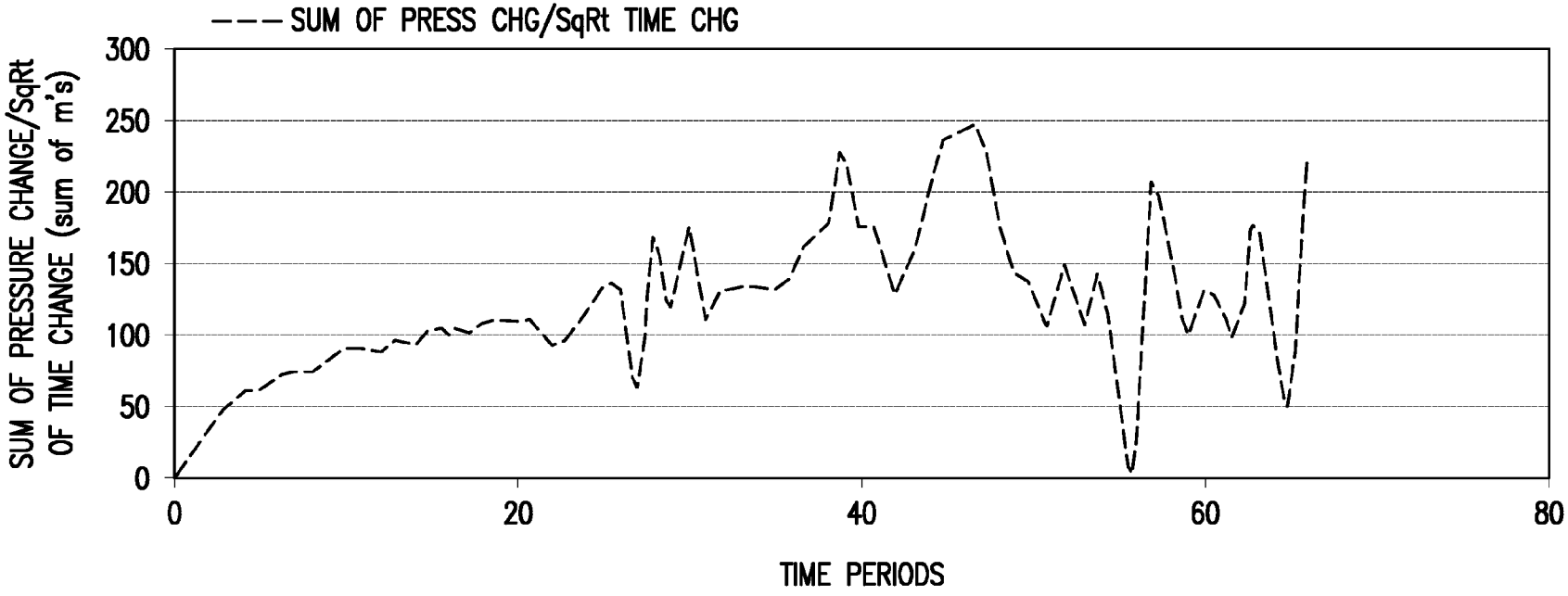
FIG. 5 is a graphical depiction of summation of the change in pressure divided by the square root of time versus time during the shut-in portion of a cycle in a well utilizing a plunger lift system for multiple cycles.

Filtering out the non-plunger bottom related anomalies can be achieved by summing the rate of change (m) values for each specific point in time for several cycles. The average plunger fall time can be observed as the time with the largest sum of positive values for the rate of change, as shown in FIG. 5.

When comparing the pressure changes associated with the plunger reaching the bottom of the well (plunger bottoming anomaly) from one cycle to the next, data frequency and slight variations in plunger fall velocity (time) can cause those indicators to occur at adjacent points in time. Using a rolling average of the amplitude of the anomalies gives more weight to anomalies in adjacent time periods, thereby giving more weight to the most time consistent anomalies (those associated with the plunger bottoming).

Figure 6:
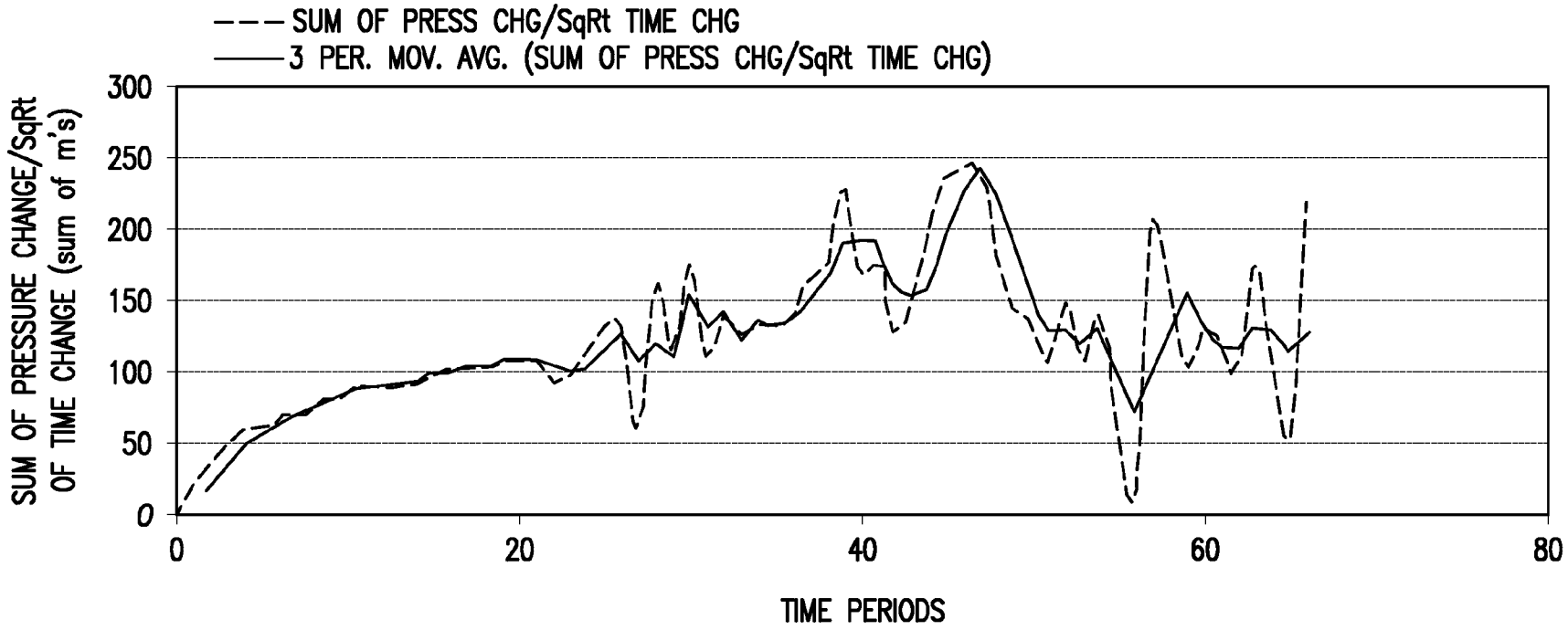
FIG. 6 is a graphical depiction of summation of the change in pressure divided by the square root of time versus time during the shut-in portion of a cycle in a well utilizing a plunger lift system for multiple cycles along with a three period rolling average of those same data points

To identify the plunger bottoming anomaly in an individual cycle while incorporating the results from multiple cycle rolling average, the anomaly in that particular cycle with the highest amplitude closest to the point in time identified by the rolling overage should be selected, as shown in FIG. 6.

Figure 7:
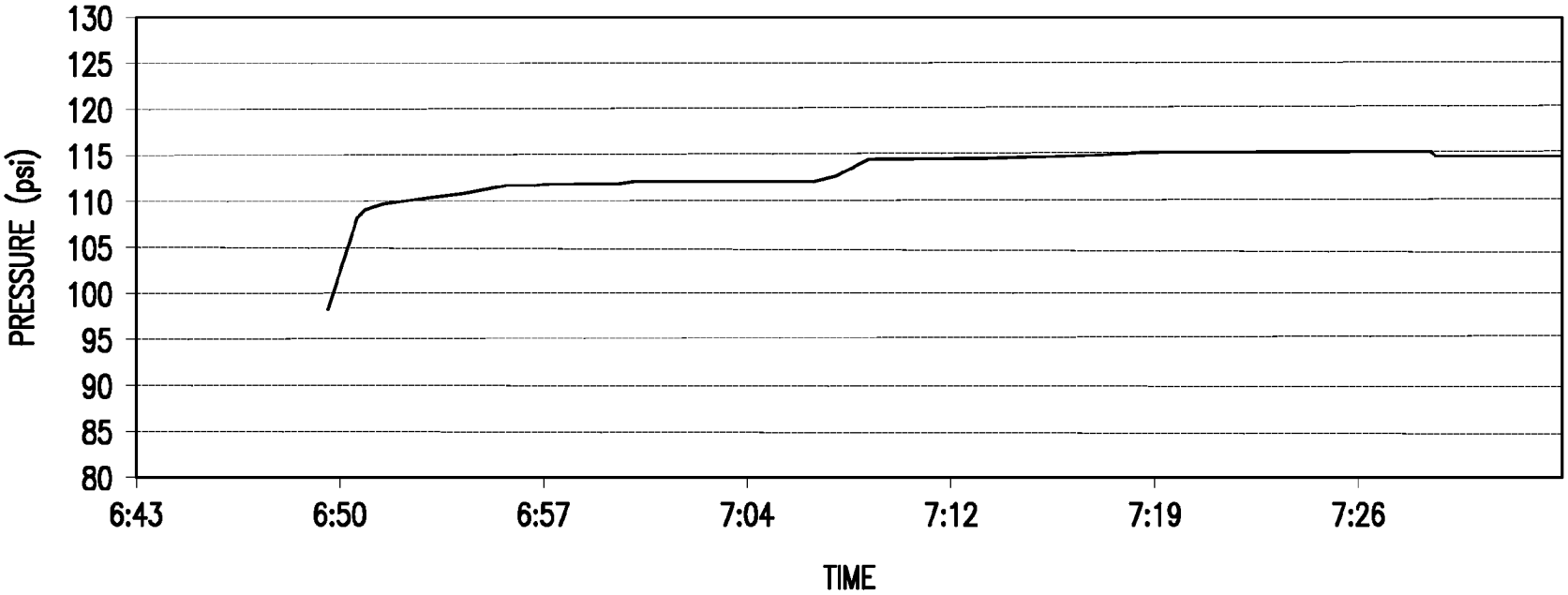
FIG. 7 is a graphical depiction of surface pressure versus time during the shut-in portion of a cycle in a well utilizing a plunger lift system.

Depending on the character of the build up rate during the early part of the shut-in cycle, there is also the potential for very large values of rate of change (m) during that first part of the build-up period as shown during the early portion of the cycle in FIG. 7.

Figure 8:
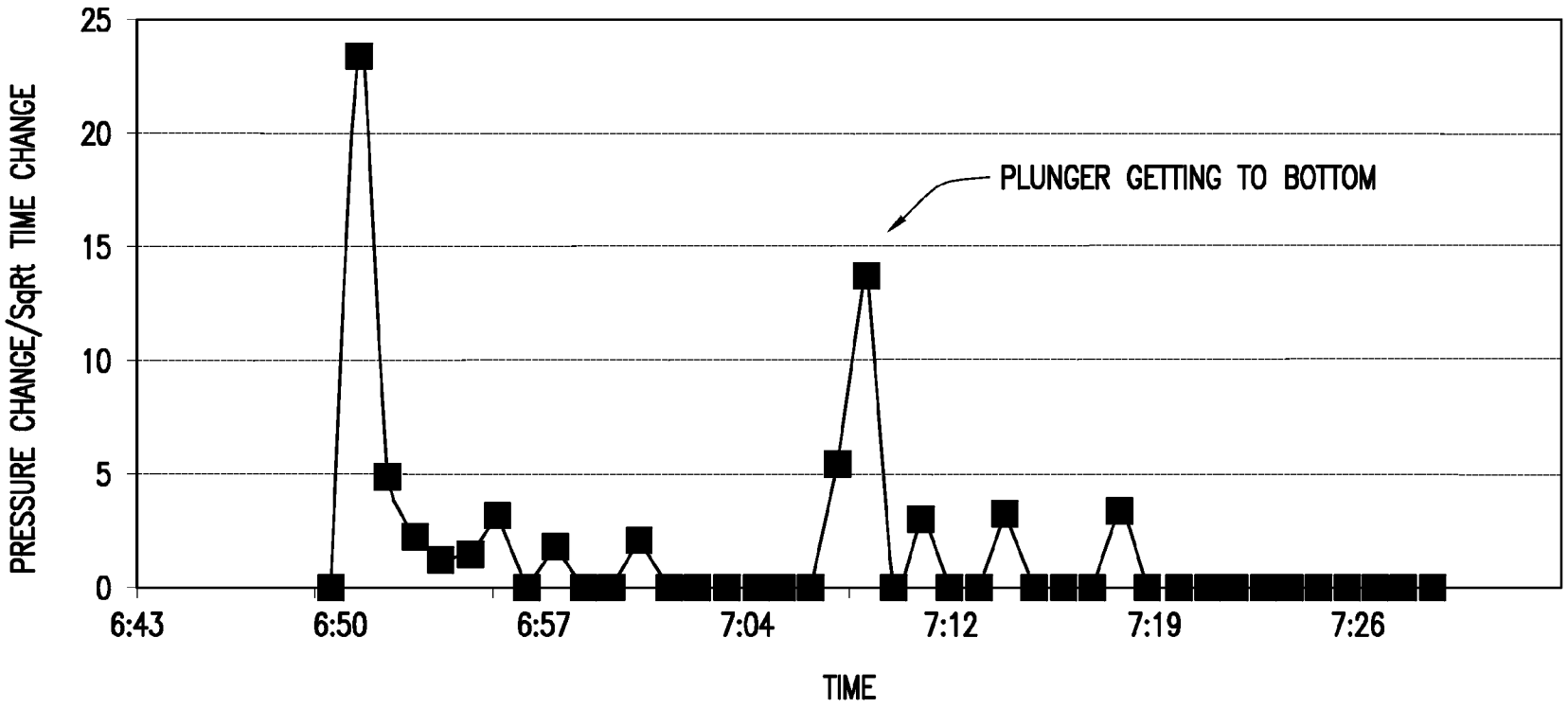
FIG. 8 is a graphical depiction of the change in pressure divided by the square root of time versus time for the shut-in portion of a cycle in a well utilizing a plunger lift system.

FIG. 8 shows the first rate of change (m) value being so large as to eclipse the pressure rise caused by the plunger getting to the bottom of the well. To eliminate the possibility of these large early values of rate of change (m) overshadowing the rate of change (m) resulting from the plunger getting to the bottom, the first part of the build-up should be ignored to eliminate outliers.

In closing, it should be noted that the discussion of any reference is not an admission that it is prior art to the present invention, especially any reference that may have a publication date after the priority date of this application. At the same time, each and every claim below is hereby incorporated into this detailed description or specification as additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

REFERENCES

All of the references cited herein are expressly incorporated by reference. The discussion of any reference is not an admission that it is prior art to the present invention, especially any reference that may have a publication data after the priority date of this application. Incorporated references are listed again here for convenience:

1. Becker, D., et al., "Plunger Lift Optimization by Monitoring and Analyzing Wellbore Acoustic Signals and Tubing and Casing Pressures," SPE 104594 (2006).

The invention claimed is:

1. A method for identifying when a plunger reaches the bottom of a well with a plunger lift system, comprising:

a. shutting in the well, wherein by shutting in the well the plunger is allowed to fall to the bottom the well and to build up energy;

b. obtaining data as the plunger falls to the bottom of the well, wherein the data includes surface pressure measurement and a corresponding time measurement;

c. establishing a relationship between a change in surface pressure and a change in time, wherein the relationship provides $$m = \frac{P_2 - P_1}{(\sqrt{T_2} - \sqrt{T_1})}$$

in which m is the rate of change, $P_1$ is the pressure at a corresponding time $T_1$ and $P_2$ is the well pressure at a corresponding time $T_2$;

d. calculating rate of change for each data point obtained while the well is shut in;

e. plotting the rate of change versus time;

f. identifying the maximum rate of change during the energy build up while filtering out anomalies not associated with the plunger reaching bottom, wherein said maximum rate of change occurs when the plunger reaches the bottom of said well; and g. opening said well when said plunger reaches the bottom of said well, thereby producing oil.

* * * * *